United States Patent [19]

Baird, Jr. et al.

[11] 4,007,109

[45] Feb. 8, 1977

[54] COMBINED DESULFURIZATION AND HYDROCONVERSION WITH ALKALI METAL OXIDES

[75] Inventors: William C. Baird, Jr.; Roby Bearden, Jr., both of Baton Rouge, La.

[73] Assignee: Exxon Research and Engineering Company, Linden, N.J.

[22] Filed: Apr. 28, 1975

[21] Appl. No.: 571,911

[52] U.S. Cl. ..... 208/108; 208/209; 208/230; 208/251 H; 208/264; 208/289; 252/439; 252/476

[51] Int. Cl.[2] ..... C10G 13/06; B01J 27/04

[58] Field of Search ..... 208/108–112, 208/208 R, 208 M; 264/209, 226; 289/230, 235

[56] References Cited

UNITED STATES PATENTS

| | | | |
|---|---|---|---|
| 1,729,943 | 10/1929 | Hofsass | 260/667 |
| 3,160,580 | 12/1964 | Aschenbach et al. | 208/226 |
| 3,787,315 | 1/1974 | Bearden et al. | 208/208 M |

*Primary Examiner*—Herbert Levine
*Assistant Examiner*—G. E. Schmitkons
*Attorney, Agent, or Firm*—Edward M. Corcoran

[57] ABSTRACT

Heavy carbonaceous feeds, including various sulfur-containing heavy petroleum oils, are simultaneously desulfurized and subjected to hydroconversion by contacting these feedstocks with alkali metal oxides in a conversion zone maintained at elevated temperatures and in the presence of hydrogen. In this manner, the feeds are substantially desulfurized, and significant upgrading of the feedstocks is also obtained as demonstrated by decreased Conradson carbon, increased API gravity, and conversion of a substantial portion of the 1,050° F+ portion of the feedstream. In addition, methods for the regeneration of the alkali metal oxides from the alkali metal sulfide salts produced in the reaction zone are disclosed.

12 Claims, 1 Drawing Figure

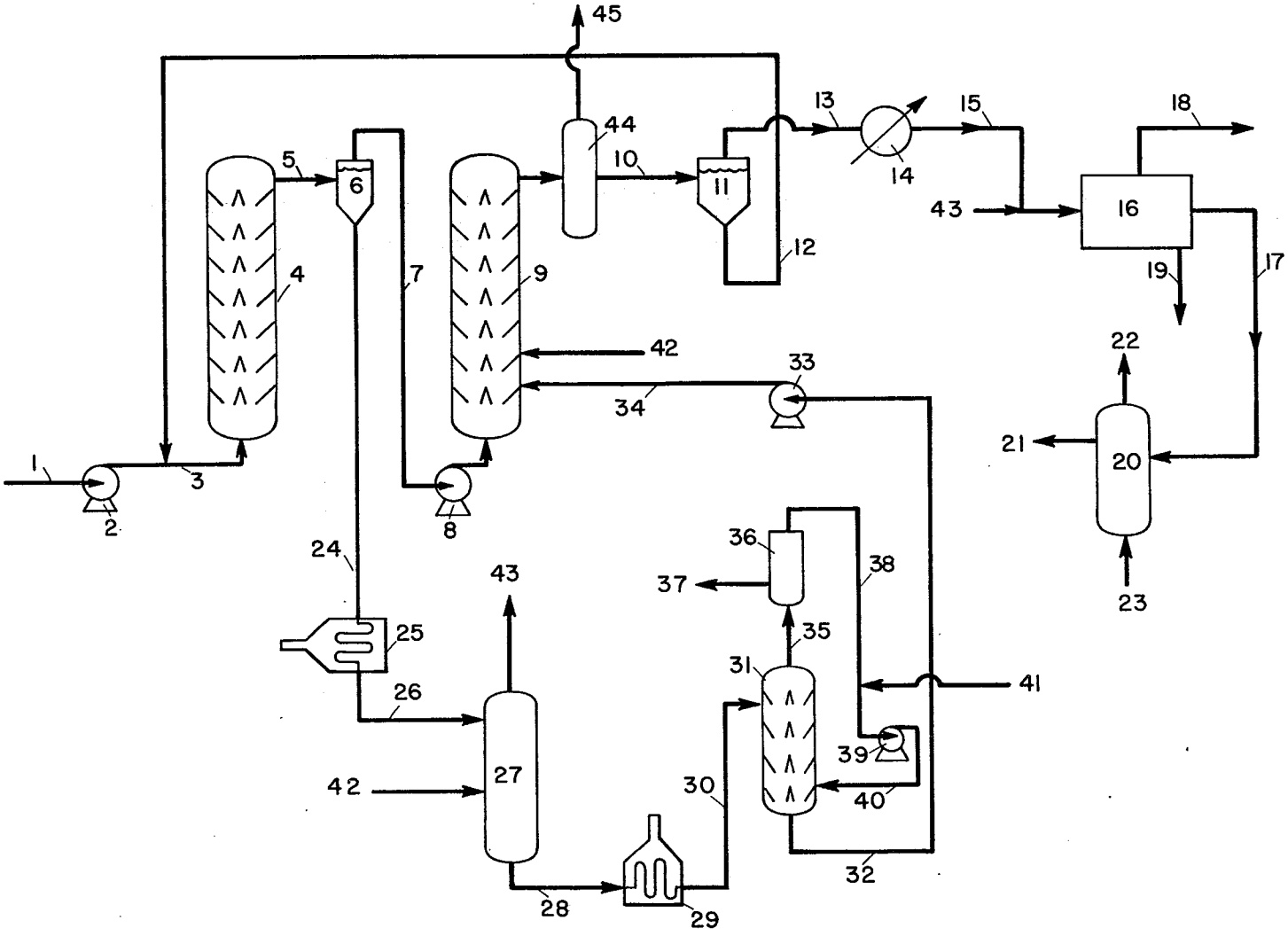
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45

COMBINED DESULFURIZATION AND HYDROCONVERSION WITH ALKALI METAL OXIDES

FIELD OF THE INVENTION

The present invention relates to a process for the combined desulfurization and conversion of sulfur-containing hydrocarbon feedstocks. More particularly, the present invention relates to processes for the combined desulfurization and hydroconversion of heavy hydrocarbon feedstocks in the presence of alkali metal oxides. Still more particularly, the invention relates to processes for the combined desulfurization and hydroconversion of sulfur-containing heavy hydrocarbon feedstocks in the presence of a desulfurization agent, wherein the desulfurization agent is regenerated and recycled therein.

DESCRIPTION OF THE PRIOR ART

Because of the large amounts of sulfur-bearing fuel oils which are currently being employed as raw materials in the petroleum refining industry, the problems of air pollution, particularly with regard to sulfur oxide emissions, has become of increasing concern. For this reason, various methods for the removal of sulfur from these feedstocks has been the subject of intensive research efforts by this industry. At present, the more practical means of desulfurizing such fuel oils is the catalytic hydrogenation of sulfur-containing molecules and petroleum hydrocarbon feeds in order to effect the removal, as hydrogen sulfide, of these sulfur-containing molecules. This process generally requires relatively high hydrogen pressures, ranging from about 700 to 3000 psig, and elevated temperatures ranging from about 650° to 800° F, depending upon the feedstock employed and the degree of desulfurization required.

Such catalytic processes are generally quite efficient when particular type feeds are being processed, but become of increased complexity and expense, and decreasing efficiency, as increasingly heavier feedstocks, such as whole or topped crudes and residua are employed. As an additional complicating factor, such residuum feedstock often are contaminated with heavy metals, such as nickel, vanadium and iron, as with alphaltenes, which tend to deposit on the catalyst and deactivate same. Furthermore, the sulfur in these feeds is generally contained in the higher molecular weight molecules which can only be broken down under the more severe operating conditions, which thus tend to degrade the feedstock due to thermal cracking, with consequent olefin and coke formation and accelerates the catalyst deactivation. Furthermore, no significant hydroconversion has been realized in these processes in conjunction with feed desulfurization and these processes have thus been employed in addition to conventional hydroconversion processes, such as catalytic cracking, hydrocracking, etc.

As an alternative hydrodesulfurization process, sodium oxide has been employed in conjunction with several prior art desulfurization processes, under various conditions. As examples, U.S. Pat. No. 2,950,245 discloses the use of alkali metal oxides as an intermediate in the distillation of minerals oils with metallic sodium; U.S. Pat. No. 1,973,499 discloses a two-stage desulfurization process employing halogenating substances for desulfurization, followed by dehalogenation employing molten alkali metal or its oxides to remove the halogen; U.S. Pat. No. 2,770,579 discloses low temperature desulfurization by distillation; and British Pat. No. 967,316 discloses the vapor phase treatment of various distillate fractions with sodium oxide. Copending application Ser. No. 571,917 filed on Apr. 28, 1975 (O.P. 969), describes the desulfurization of petroleum feeds with sodium oxide under mild temperature (600°–750° F) and hydrogen pressure (50–1000 psig) conditions. While these techniques have proven successful with regard to desulfurization, the search has continued for improved process in which not only is feed sulfurization obtainable, but also where the simultaneous conversion of heavy hydrocarbon feeds to move valuable distillate products, such as gasoline, naphtha, fuel oil and heating oil, can be attained. Further, improved methods for regenerating the products produced by the contact of the desulfurization agent in the reaction zone have also been sought.

SUMMARY OF THE INVENTION

In accordance with this invention an efficient, virtually quantitative desulfurization and extensive feed upgrading and conversion process is presented, wherein heavy hydrocarbon materials, e.g., whole or topped crudes or residua, are contacted while in the liquid phase, with alkali metal oxides, and hydrogen, at temperaures ranging from about 750° F to about 2000° F, in the presence of high pressure hydrogen. The reaction product comprises a desulfurized, highly upgraded hydrocarbon feedstock and various sodium salts, e.g., primarily the alkali metal sulfides and hydroxides which are separated from the hydrocarbon phase by physical means such as filtration, centrifugation, or by a settling and draw-off procedure provided that the selected treat temperature is above the salt mixture melting point. Preferably, the salt phase is then recycled to treat fresh residua feed, to thus effect partial removal of the metals and sulfur therefrom, thereby minimizing the requirement for alkali metal oxide.

The process of this invention is generally applicable to any sulfur bearing feedstock. Thus, while the process is applicable to distillates, the process is particularly effective when utilized to desulfurize heavy hydrocarbons, e.g., those containing residual oils. Preferably, therefore, the process disclosed herein is utilized for the desulfurization of whole or topped crude oils and residua. Crude oils obtained from any area of the world such as the Middle East, e.g., Safaniya, Arabian heavy, Iranian light, Gach Saran, Kuwait, etc., as well as U.S. or Venezuelan, e.g., Laquinillas, Tia Juana, Bachequero, etc., can be desulfurized by the process of this invention. Additionally, both atmospheric residuum (boiling above about 650° F) and vacuum residuum (boiling above about 1,050° F) can be treated. Preferably, the feedstock is a sulfur bearing heavy hydrocarbon oil having at least about 10% of material boiling about 1,050° F, more preferably at least about 25% of material boiling about 1,050° F.

The feedstock may be directly introduced into a contacting zone for desulfurization without pretreatment. It is desirable, however, to desalt the feedstock in order to prevent NaCl contamination of the sodium salt products of the desulfurization reaction. Desalting is well known in the refining industry and may be effected by the addition of small amounts of water to the feedstock to dissolve the salt followed by the use of electrical coalescers. The oil is then dehydrated by conventional means.

If it is desired to recycle salt products from alkali metal oxide treating, i.e., primarily a mixture of alkali metal sulfides and hydroxides, to treat fresh feeds, then the desalting and dewatering steps can be omitted. Feed contact with the salt mixture at 600° to 700° F., not only removes a portion of the feed sulfur and metals content but also effectively removes salt, iron scale and small amounts of water from the oil.

The alkali metal oxides which may be employed in the present process generally include the oxides of those metals contained in Group IA of the Periodic Table of the Elements. Specifically, it has been found that the oxides of lithium, sodium, potassium, rubidium and cesium are particularly useful in this process. The preferred oxide is sodium oxide, particularly due to its ready availability as well as the ease with which it may be recovered and regenerated for further use.

The alkali metal oxides can be blended into the feedstock in a granular form ranging from powders (100+ microns) to particles (14 to 34 mesh range) or as a molten spray. The spray or powders are preferred, however, in order to maximize reaction rate and minimize the need for mechanical agitation beyond the point of initial blending of powders and feedstock. The amount of sodium oxide employed generally is a function of the sulfur content of the feedstock and the degree of desulfurization desired. Generally, about 2.0 to 3.0 moles of alkali metal oxide is used per mole of feed sulfur to be removed, preferably 2.5 to 2.8 moles/mole. Ratios above three based on total moles of sulfur present are to be avoided as they promote formation of a polymeric coke product and loss of the desirable liquid product oil.

Contact of the alkali metal oxide and the feedstock is carried out at reaction conditions designed to maintain the bulk of the feedstock, and preferably substantially all of the feedstock in the liquid phase. Conditions may, however, be varied to provide for vapor phase contact. Reaction temperatures will generally range from about 750°, to about 2,000° F, preferably from about 750°, to 1,000° F, and still more preferably from about 800°, to about 850° F.

A hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat cracker or reformer light ends streams, naphtha reformer recycle hydrogen streams, and the like). However, introduced hydrogen partial pressures in the contacting zone can range from about 1,000 to 5000 psig, preferably about 1,000 to 3,000 psig, and more preferably from about 1,500 to 2,500 psig.

Total system pressures may vary widely and will normally vary based on the feedstock to be treated, the reaction temperature, and the desired hydrogen partial pressure. Thus, for reduced crudes the minimum total pressure will be in the range of from about 750 to 1,000 psig, and preferably from about 1,500 to 2,000 psig. For whole or topped crudes, total pressures may range as high as about 1,200 to 1,300 psig in order to maintain the feedstock substantially in the liquid phase and to provide the desired hydrogen partial pressure.

The desulfurization step can be conducted as a batch or continuous type operation. The apparatus used in the desulfurization step is of a conventional nature and can comprise a single reactor or multiple reactors equipped with shed rows or other stationary devices to encourage contacting; orifice mixers; efficient stirring devices such as mechanical agitators, jets of restricted internal diameter, turbomixers and the like.

The hydrocarbon feedstock and the alkali metal oxide can be passed through one or more reactors in concurrent, crosscurrent, or countercurrent flow, etc. It is essential that oxygen and water be excluded from the reaction zones; therefore, the reaction system is normally purged with dry nitrogen and the feedstock dried prior to introduction into the reactor. It is understood that trace amounts of water, i.e., less than about 0.5 weight percent, preferably less than about 0.1 weight percent based on total feed, can be present in the reactor. Where there are larger amounts of water, process efficiency will be lowered somewhat as a consequence of alkali metal oxide reacting with the water. The resulting oil dispersion is subsequently removed from the desulfurization zone and resolved by conventional means as described in more detail below for the preferred reagent, sodium oxide.

The salt product mixture produced in sodium oxide treating is normally molten in the preferred process temperature range of 800° to 850° F. Since the molten salt is not miscible with oil and is considerably more dense than the oil, separation is achieved by drawing off the molten salt layer. At treat temperatures below about 600° F, dispersions of solid salt particles in oil are obtained which can be resolved by conventional means, i.e., filtration or centriguation.

Desulfurization salt mixtures recovered from sodium oxide-hydrogen treating of feedstocks mentioned hereinabove are believed to have the approximate composition noted below. If the mixture is recycled to treat fresh feed, then the $Na_2S$ concentration will increase somewhat at the expense of NaOH.

DESULFURIZATION SALT COMPOSITION

DESULFURIZATION SALT COMPOSITION

| Component | Mole % |
|---|---|
| $Na_2S$ | 25.3 |
| NaOH | 71.5 |
| $Na_2S_2O_3$, $Na_2SO_3$, $Na_2CO_3$ | 3.2 |

The mixture is also believed to contain small amounts of metal (nickel, vanadium and iron) salts, as well as any coke that may be produced in the treating process.

Steps essential to the regeneration of alkali metal oxides such as sodium oxide from mixtures of sodium sulfide and sodium hydroxide are described in part in the literature and are believed applicable to the other alkali metal oxides. Basically, regeneration involves converting substantially all and preferably the entire salt mixture to sodium hydroxide, converting sodium hydroxide to sodium sulfite, and then pyrolyzing the sodium sulfite to obtain sodium oxide and sulfur dioxide. These steps are presented below.

STEP A

SALT CONVERSION TO NaOH VIA THERMOLYSIS

In this method, the molten NaOH-$Na_2S$ mixture from the desulfurization step is stripped with steam above about 1,200° F, to effect decomposition of sodium sulfide to sodium hydroxide and hydrogen sulfide. The procedure is described by Gossage in British Patent No. 1176.

$$Na_2S + H_2O \rightarrow 2NaOH + H_2S$$

Hydrogen sulfide produced in the thermolysis step is converted to elemental suflur via the Claus Process.

STEP B

SODIUM SULFITE FORMATION

Molten sodium hydroxide is sprayed into a reactor at 300° to 500° F, where contact is made with steam and sulfur dioxide to produce sodium sulfite.

$$2NaOH + SO_2 \rightarrow Na_2SO_3 + H_2O$$

STEP C

SODIUM SULFITE CONVERSION TO SODIUM OXIDE

Sodium sulfite powder from Step B is fired to roughly 1,700° F, where decomposition[1] occurs to yield sodium oxide and sulfur dioxide.

1. F. Forster and K. Kubel, Ziet. Phys. Chem., 139 261(1924); W. Sack, Z. Inorg. U. Allgem. Chem., 264, 255(1951).

$$Na_2SO_3 \underset{}{\overset{1700° F.}{\rightleftharpoons}} Na_2O + SO_2$$

Sodium oxide, which is molten at 1,700° F, is recycled to the desulfurization reactor where it is sprayed directly into the oil or is first spray-dried and added as a finely divided solid. Sulfur dioxide is recycled to Step B for conversion of sodium hydroxide to the sulfite.

A possible alternative scheme which omits the direct conversion to sodium sulfite is as follows. Molten sodium hydroxide obtained in Step A is bubbled or contacted at 1,700° F, with a small amount of sulfur dioxide, preferably no more than about 10 mole % on the total charge of NaOH, to promote the conversion of sodium hydroxide to the oxide. In effect, the sulfur dioxide serves as a catalyst for the reaction.

$$2NaOH \xrightarrow{SO_2} Na_2O + H_2O$$

The molten $Na_2O$ product or mixtures of the oxide with hydroxide and sulfite are recycled to the desulfurization zone and can be sprayed directly into the residua feed.

Further, the sodium oxide can be regenerated by converting the sodium salt product from the treating step to a feed suited to the electrolytic or carbothermal formation of sodium metal generating sodium and then carrying out the controlled oxidation of sodium to sodium oxide as described in U.S. Pat. No. 1,685,520. One suitable feed for electrolysis is sodium chloride which is readily prepared by treating the salt product with hydrochloric acid. The resultant sodium chloride is then decomposed to metallic sodium and chlorine in a DOWNS Cell as described in U.S. Pat. No. 1,501,756, all of which is incorporated herein by reference thereto. In another scheme the sodium salt product from sodium oxide treating is converted to sodium tetrasulfide by sequential treating with hydrogen sulfide and molten sulfur. The polysulfide is then electrolyzed to yield sodium metal in an improved cell wherein the cathode and anode compartments are separated by a sodium ion permeable membrane of beta-alumina. This procedure is described in detail in U.S. Pat. Nos. 3,791,966, 3,787,315 and 3,788,978, and again, these disclosures are incorporated herein by reference thereto. For the carbothermal route to sodium metal, the sodium salt product is treated with steam and carbon dioxide to form sodium carbonate which is then decomposed thermally in the presence of carbon according to the procedure given in U.S. Pat. No. 2,162,619, also incorporated herein by reference thereto.

DESCRIPTION OF THE DRAWING

The accompanying FIGURE presents a simplified scheme for the preferred process embodiment for the desulfurization of residua feeds with sodium oxide and for the regeneration of the sodium oxide from the salt products of desulfurization.

Referring to the FIGURE, a sulfur-containing feedstock, preheated to 600° to 650° F, is fed by means of line 1 to pump 2 where the discharge pressure is set to exceed the autogeneous pressure of the feedstock at the treat temperature, e.g., about 150 psig for atmospheric residua feeds at 650° F. The feed is discharged through line 3 where it contacts a molten $NaOH$-$Na_2S$ stream entering from line 12. The dispersion is then fed upflow in reactor 4 which contains baffles to promote continuing contact between the molten caustic and oil. Holding time in the reactor is on the order of 15 to 30 minutes. Reactor effluent exits via line 5 to settler vessel 6 to disengage the oil-molten salt mixture. The entering mixture is introduced below the level of the molten salt in the vessel thereby facilitating the oil-salt separation. Holding time in the vessel is on the order of 5 to 10 minutes at roughly 650° F.

Treated oil exits settler vessel 6 via line 7 and enters charging pump 8, where the pressure is raised to about 2,500 3,000 psig, and then to the sodium oxide treating reactor 9. The reactor contains baffles to promote continuing contact of oil and sodium oxide which is sprayed into the reactor in molten form from line 34. Hydrogen is introduced into reactor vessel 9 via line 42 in amounts such that the partial pressure of hydrogen in the reactor ranges between 2,000 and 2,500 psig. Holding time in the reactor is about 15 to 60 minutes and is preferably 30 minutes. Reactor inlet temperature is in the range of 800° to 825° F, and the outlet temperature is on the order of 850° to 900° F. The desulfurized feedstock containing dispersed sodium sulfide and sodium hydroxide leaves reactor 9 and enters stripping tower 44 where the pressure is lowered to roughly 500 psig. Excess hydrogen along with light hydrocarbon products exit through line 45 and are subsequently resolved in conventional equipment not shown. Hydrogen is compressed and recycled to reactor 9. Light hydrocarbon products are directed to storage. The resultant oil-salt mixture, still at about 700° F, is fed via line 10 to separator vessel 11 where the dispersion enters below and rises through a layer of molten $NaOH$-$Na_2S$ to promote separation of oil-salt dispersion. Molten salt removed through line 12 is recycled to contact fresh entering feed at line 3. Essentially salt-free desulfurized oil is withdrawn from vessel 11 through line 13 and cooled to about 250° F, in heat exchanger 14.

Oil exiting heat exchanger 14 via line 15 is blended with a small amount of a dilute acid such as sulfuric acid or acetic acid to decompose any organic salts of sodium as well as small entrained amounts of sodium sulfide. The acid-containing mixture enters electrostatic precipitator vessel 16 where the acidic aqueous phase and the oil phase are resolved. The aqueous phase is withdrawn through line 19 and is discarded. Excess hydrogen, light hydrocarbons and traces of $H_2S$ and water vapor are taken overhead through line 18 to separators not shown. Desulfurized, salt-free oil is withdrawn through line 17 to steam stripper vessel 20 where 250° to 300° F, steam is used to remove final traces of light gases including $H_2S$. Steam enters through line 23. The steam effluent exits via line 22. Clean oil is then removed via line 21 to storage.

Molten salt removed from separator vessel 6 via line 24 enters furnace 25 where the melt temperature is raised to about 1,200° F, and then is fed via line 26 to the thermolysis reactor 27 where contact is made with superheated steam entering from line 42. Steam and hydrogen sulfide obtained from sodium sulfide hydrolysis are vented through line 43. After condensing out the water, the $H_2S$ is sent to a Claus plant (not shown) for conversion to elemental sulfur. Molten sodium hydroxide exiting vessel 27 via line 28 is fed to furnace 29 where the temperature is raised to about 1,800° F, and then through line 30 to the sodium oxide regeneration vessel 31.

Reactor 31 is lined internally with Carborundum's Monofrax A-2, a material resistant to corrosion by molten sodium oxide and sodium hydroxide. Molten sodium hydroxide flows downward over baffle plates and is mixed with sulfur dioxide entering through line 40. The sulfur dioxide reacts with sodium hydroxide to produce sodium sulfite, which decomposes above 1,600° F, to yield sodium oxide and sulfur dioxide. Water vapor and sulfur dioxide leaving the reactor via line 35 enter condenser 36, which operates near 180° F. Sulfur dioxide solubility in water is minimal at this temperature, thus permitting the bulk of the sulfur dioxide to be recycled through line 38, compressor 39 and line 40 to reactor 31. Makeup sulfur dioxide is added via line 41 to maintain a $SO_2$/NaOH mole ratio of from about 0.05 to 0.1. Contact time, normally 1 to 2 hours at 1,700° F, is adjusted to provide an effluent stream containing at least 60 wt. % and preferably 80 wt. % sodium oxide. The molten sodium oxide-sodium hydroxide stream is drawn from reactor 31 via line 32, pressurized up to about 500 psig, in pump 33, and then fed back into reactor 9 as a molten spray entering through line 34.

DESCRIPTION OF PREFERRED EMBODIMENTS

A. Desulfurization of Residua

The reactor consists of a standard 300 cc Autoclave Engineer's autoclave, which is constructed of Hastelloy-c steel. The reactor head contains the usual openings and fittings for measurement of pressure and temperature and for the addition of gases.

In a series of runs, the reactor was charged at room temperature with the desired quantity of sulfur-containing oil and desulfurization reagent, usually in powder or granular form. The reactor was sealed and thoroughly flushed with $H_2$. Usually, 1,500 to 1,800 psig of the $H_2$ was present when heatup began. The reactor temperature was brought to run temperature as quickly as possible with stirring (for approximately 30 min.) and the $H_2$ pressure was adjusted to the desired run value. For runs without hydrogen, nitrogen was used to purge the reactor prior to heatup.

The yield of gaseous products, comprising materials lighter than or the same weight as pentane, was determined by cooling the reactor to room temperature, venting the gases through a wet test flow meter to determine volume, and then carrying out a component analysis upon a representative sample by mass spectrometry.

Coke formed in the desulfurization reaction was normally isolated with the desulfurization salt products and was recovered by dissolving the salts in water.

B. Separation of the Oil and Salt Phases

After the designated reaction period was completed, the reactor contents were maintained above 750° F, for 10 minutes, and then cooled to about 200° to 250° F, depressurized, and the product mixture filtered through a number 2 grade Whatman paper to achieve separation of salts and oil. The salt cake was subsequently washed free of adhering oil with toluene, dried under vacuum and stored under nitrogen. The product oil, including small amounts recovered from the toluene wash of salt products, was treated with acetic acid to remove traces of oil soluble alkali metal salts such as the mercaptides and again filtered prior to the carrying out of routine product inspections. The acetic acid step consisted of treating a toluene diluted sample of the oil with 1 wt. % glacial acetic acid, based on the weight of the oil, for about 30 minutes at 180° F, vacuum stripping to remove toluene and excess acetic acid and then hot filtering to separate oil from traces of alkali metal acetates.

C. Oil Product Analyses

In each run oil products were analyzed not only for sulfur content, but also for changes in metals content and general physical properties such as API gravity, viscosity asphaltene content, and Conradson carbon content.

PREFERRED EMBODIMENTS

Example 1 through 7

The combined desulfurization and hydroconversion of a Safaniya atmospheric residuum feedstock, as shown in Table I was carried out employing various alkali metal oxides. The results obtained, and the process conditions employed, are contained in Table II hereof.

These results clearly demonstrate the effectiveness of each of these alkali metal oxides not only for the deep desulfurization of the sulfur-containing feedstock employed, but also for the hydroconversion of same. Thus, Conradson carbon losses of between 30 and 60 percent were obtained, the asphaltene content of the feeds was reduced by between about 60 to 85 percent, and significantly between about 30 and 50 weight percent of the 1,050° F+ fraction was hydroconverted to lighter materials with minimal coke and $C_4$-gas yields. In addition, high degrees of demetallization ranging between about 80 and 95 weight percent, were also obtained.

TABLE I

| FEEDSTOCK INSPECTION OF SAFANIYA ATMOSPHERIC RESIDUUM EMPLOYED IN EXAMPLE I | |
|---|---|
| API Gravity | 14.4 |
| Sulfur, Wt. % | 3.91 |
| Nitrogen, Wt. % | 0.26 |
| Carbon, Wt. % | 84.42 |
| Hydrogen, Wt. % | 11.14 |
| Oxygen, WT. % | 0.27 |
| Conradson Carbon, Wt. % | 11.8 |
| Asphaltenes | 17 |
| Metals, ppm | |
| Ni | 20 |

TABLE I-continued

| FEEDSTOCK INSPECTION OF SAFANIYA ATMOSPHERIC RESIDUUM EMPLOYED IN EXAMPLE I | | |
|---|---|---|
| V | 77 | 101 |
| Fe | 4 | |
| Viscosity | | |
| VSF 122° F | 235 | |
| 124° F | 131 | |
| 210° F | — | |
| Pour Point, ° F | 33 | |
| Naphtha Insolubles, Wt. % | 7 | |
| Distillation | | |
| IBP, ° F | 464 | |
| 5% | 569 | |
| 10% | 632 | |
| 20% | 724 | |
| 30% | 806 | |
| 40% | 883 | |
| 50% | 962 | |
| 60% | 1037 | |
| 70% | | |
| 80% | | |
| 90% | | |
| 95% | | |
| FBP | 1035 | |
| % Rec. | 59.2 | |
| % Res. | 40.8 | |

TABLE II

DESULFURIZATION AND HYDROCONVERSION OF SAFANIYA ATMOSPHERIC RESIDUA WITH ALKALI METAL OXIDES

| Run No. | 1 | 2 | 3 | 4 | 5 | 6 | 7 |
|---|---|---|---|---|---|---|---|
| Reagent ($M_2O$) (Wt. % on feed) | $Na_2O$(19) | $Li_2O$(6) | $Na_2O$(10) | $Na_2O$(20) | $Li_2O$(8) | $Li_2O$(18) | $Cs_2O$(14) |
| Reaction Conditions | | | | | | | |
| $H_2$, psig | 200 | 200 | 1700 | 1700 | 1700 | 1700 | 1800 |
| Temp., ° F | 650 | 650 | 830 | 830 | 820 | 820 | 820 |
| Product Inspections | | | | | | | |
| Sulfur, Wt. % | 0.6 | 3.8 | 1.5 | 0.6 | 1.9 | 1.8 | 1.9 |
| Con. Carbon, Wt. % | 5.5 | 4.3 | 7.7 | 5.3 | 8.2 | 7.5 | 5.9 |
| Ni/V/Fe, ppm | 27/35/4 | 21/68/6 | 3/2/1 | 3/0/2 | 5/3/2 | 5/5/3 | 3/7/0 |
| API Gravity | 19.9 | 14.7 | 24.5 | 26.0 | 17.4 | 17.4 | 24.5 |
| Asphaltenes, Wt. % | — | — | 4.5 | 2.4 | 2.7 | 2.4 | 4.7 |
| Desulfurization % | 85 | 3 | 62 | 86 | 51 | 55 | 47 |
| Con. Carbon Conversion % | 55 | 64 | 36 | 56 | 32 | 38 | 37 |
| Demetallization % | 35 | 12 | 94 | 95 | 90 | 87 | 89 |
| Products, Wt. % | | | | | | | |
| $C_1$/C4 | — | — | 4.3 | 2.5 | 1.6 | 2.4 | 2.6 |
| Coke | 0.7 | — | 1.9 | 2.1 | 0.4 | 0.7 | 1.3 |
| $C_5^+$liquid | — | — | 91.3 | 92.1 | 96.0 | 94.7 | 94.0 |

What is claimed is:

1. A process for the combined desulfurization and hydroconversion of a sulfur-containing heavy hydrocarbon feedback containing at least about 10 weight percent materials boiling above about 1,050° F, which comprises contacting said hydrocarbon feedstock, while in the liquid phase, with an alkali metal oxide in a conversion zone, in the presence of sufficient added hydrogen to product a hydrogen pressure of from about 1,000 to 5,000 psig, said conversion zone being maintained at elevated temperatures ranging from about 750° to 2,000° F, so that the sulfur content of said heavy hydrocarbon feedstock is substantially reduced and said hydrocarbon feedstock is simultaneously subjected to hydroconversion such that the 1,050° F+ fraction thereof is converted to lower-boiling products.

2. The process of claim 1 wherein said elevated temperatures range from between about 750° and 1,000° F.

3. The process of claim 1 wherein said alkali metal oxide comprises an oxide of a metal selected from the group consisting of sodium, lithium, potassium, rubidium, cesium and mixtures thereof.

4. The process of claim 1 wherein said alkali metal oxide is present in said conversion zone in a finely divided state.

5. The process of claim 1 wherein said alkali metal oxide to feed sulfur mole ratio ranges from about 2.0 to 3.0.

6. The process of claim 1 wherein said hydrocarbon feedstock is maintained in a substantially liquid phase within said conversion zone.

7. The process of claim 1 wherein said hydrogen is maintained in said conversion zone at a pressure between about 1,000 and 3,000 psig.

8. A process for the combined desulfurization and hydroconversion of a sulfur-containing heavy hydrocarbon feedstock containing a substantial amount of materials boiling above about 1,050° F, which comprises contacting said feedstock while in the liquid phase with an alkali metal oxide in a conversion zone, in the presence of added hydrogen, said conversion zone being maintained at a temperature between about 750° and 1,000° F, whereby alkali metal sulfides are formed in said conversion zone, and further whereby the sulfur content of said hydrocarbon feedstock is substantially reduced, and wherein the 1,050° F+ fraction of said hydrocarbon feedstock is hydroconverted to lighter hydrocarbon materials, and regenerating said alkali metal oxides from said alkali metal sulfides and recycling said alkali metal oxides to said conversion zone.

9. The process of claim 8 wherein said hydrogen in said conversion zone is maintained at a pressure of between about 1,000 to 5,000 psig.

10. The process of claim 8 wherein said alkali metal oxides are regenerated by contacting said alkali metal sulfides with steam to obtain conversion to alkali metal hydroxides, and including reacting said alkali hydroxide with steam and sulfur dioxide to produce alkali metal sulfite, and subsequently pyrolyzing said alkali metal sulfite to produce alkali metal oxides and sulfur dioxide.

11. The process of claim 8 wherein said alkali metal oxides are selected from the group consisting of the oxides of sodium, lithium, rubidium, cesium, and potassium, and mixtures thereof.

12. The process of claim 8 wherein said alkali metal oxide comprises sodium oxide.

* * * * *